US009765456B2

(12) United States Patent
Sauter

(10) Patent No.: US 9,765,456 B2
(45) Date of Patent: Sep. 19, 2017

(54) KNITTING TOOL FOR KNITTING MACHINES

(71) Applicant: Groz-Beckert KG, Albstadt (DE)

(72) Inventor: Jörg Sauter, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 15/301,272

(22) PCT Filed: Mar. 20, 2015

(86) PCT No.: PCT/EP2015/055987
§ 371 (c)(1),
(2) Date: Sep. 30, 2016

(87) PCT Pub. No.: WO2015/150123
PCT Pub. Date: Oct. 8, 2015

(65) Prior Publication Data

US 2017/0029990 A1 Feb. 2, 2017

(30) Foreign Application Priority Data

Apr. 3, 2014 (EP) ..... 14163453

(51) Int. Cl.
*D04B 35/02* (2006.01)
*D04B 35/04* (2006.01)

(52) U.S. Cl.
CPC ..... *D04B 35/02* (2013.01); *D04B 35/04* (2013.01)

(58) Field of Classification Search
CPC ..... D04B 35/02; D04B 35/04
(Continued)

(56) References Cited

U.S. PATENT DOCUMENTS 3,949,572 A * 4/1976 Kopal ..... D04B 35/02 66/115
4,036,036 A * 7/1977 Ashmead ..... D04B 35/04 66/123

(Continued)

FOREIGN PATENT DOCUMENTS

DE 680319 C 8/1939
DE 2063724 A1 7/1971

(Continued)

OTHER PUBLICATIONS

International Search Report and written opinion in corresponding International Application No. PCT/EP2015/055987, dated May 28, 2015, 4 pages.

(Continued)

*Primary Examiner* — Danny Worrell
(74) *Attorney, Agent, or Firm* — Fitch, Even, Tabin & Flannery LLP

(57) ABSTRACT

A knitting tool (10), preferably a latch needle, intended for fast-running knitting machines has a meandering shaft with reduced-thickness regions. The meandering shaft is adjoined by a straight shaft extension (16) which likewise has a reduced-thickness portion (32). The shaft extension (16) is distinguished from the shaft (15) by way of its height H2, which is less than the height H1 of the shaft (15). The reduced-thickness region (32) of the shaft extension (16) has a length which is at least much greater than the length of the stitch-forming structure (28) carried by the shaft extension (16). Preferably, the reduced-thickness region (32) is longer overall than the non-reduced-thickness region of the shaft extension (16). With this configuration, a surprisingly efficient high-speed-compatible knitting tool (10) is created.

14 Claims, 8 Drawing Sheets

(58) Field of Classification Search
USPC ..... 66/123
See application file for complete search history.

(56) References Cited

U.S. PATENT DOCUMENTS

| | | | | | |
|---|---|---|---|---|---|
| 4,255,948 | A * | 3/1981 | Sanders | D04B 35/04 | 66/123 |
| 4,625,527 | A * | 12/1986 | Fukuhara | D04B 35/04 | 66/120 |
| 4,681,150 | A | 7/1987 | Fukuhara | | |
| 5,901,582 | A * | 5/1999 | Hennig | D04B 35/02 | 66/123 |
| 6,122,938 | A * | 9/2000 | Henning | D04B 15/10 | 66/123 |
| 6,298,692 | B1 * | 10/2001 | Kuroda | D04B 15/06 | 66/116 |
| 6,860,121 | B2 * | 3/2005 | Jurgens | D04B 35/02 | 66/123 |
| 6,892,556 | B2 * | 5/2005 | Landenberger | D04B 35/04 | 66/123 |
| 7,874,183 | B2 * | 1/2011 | Fehrenbacher | D04B 35/04 | 66/123 |

FOREIGN PATENT DOCUMENTS

| | | | |
|---|---|---|---|
| DE | 3612316 | A1 | 10/1986 |
| DE | 19604954 | C1 | 2/1997 |
| DE | 19740985 | A1 | 4/1999 |
| DE | 19939929 | A1 | 4/2000 |
| GB | 1333568 | A | 10/1973 |

OTHER PUBLICATIONS

Office action in corresponding Bangladeshi Application No. 102/2015/843, dated Jul. 3, 2016, 2 pages.
European search report in corresponding European Application No. 14163453, dated May 28, 2014, 3 pages.
European office action in corresponding European Application No. 14163453, dated Apr. 11, 2016, 3 pages.

* cited by examiner

Litespeed 2.0 - Needles with Other Allowed Forms

KNITTING TOOL FOR KNITTING MACHINES

CROSS REFERENCE TO RELATED APPLICATIONS

This patent application is the national phase of PCT/EP2015/055987 filed Mar. 20, 2015, which claims the benefit of European Patent Application No. 14163453.5 filed Apr. 3, 2014.

TECHNICAL FIELD

The invention relates to a knitting tool for a flat bed knitting machine or circular knitting machine comprising at least one needle bed having guiding grooves in which such knitting tools are movably guided.

BACKGROUND

Publication DE 197 40 985 C2 discloses punched knitting tools, in particular latch needles, that are adapted to be moved back and forth in longitudinal direction in guiding grooves of corresponding needle beds. These knitting tools comprise a shaft configured as a meander-shaped strip that defines a first height and extends away from the foot. The thickness of this shaft is reduced at some points. Extending from the shaft, there is a straight shaft extension that has, on its end remote from the shaft, a stitch-forming part that is configured, for example, as a hook and an immovably supported latch. In doing so, the stitch-forming part is that part of the knitting tool that is needed for the formation of stitches. The straight shaft extension has a second height that is lower than the first height of the shaft. The shaft extension has a uniform height. It is only the transition between the shaft and the shaft extension that is still configured with reduced thickness.

Such knitting tools have proven themselves to be excellent in practical applications because they allow faster knitting speeds.

There exist numerous additional suggestions for providing knitting tools with locations of reduced thickness. For example, German Patent 680 319 discloses a knitting tool with a laterally flexible shaft that is adjoined by a non-thickness-reduced shaft extension. During the knitting operation, the shaft is driven out of its guiding groove so that the thickness-reduced region of the shaft may act as a laterally flexible leaf spring. For a stitch transfer, the laterally flexible needle can be resiliently bent by a control member in order to come into contact with another needle.

As opposed to this, German Patent 20 63 724 discloses a needle, in which case the shaft displays reduced thickness in the region of the needle foot. This is to allow an elastic deformation of the shaft in order avoid a jamming of the shaft when it impacts the needle foot on a tappet part.

Publication DE 36 12 316 A1 discloses another embodiment of a needle with partially reduced thickness. In that case, the flanks of the shaft of the needle are provided with flat grooves extending in longitudinal direction. The shaft may be configured as a meander-shaped strip. A shaft extension extends from said shaft, said extension transitioning into a stitch-forming structure at its end. The shaft extension displays non-reduced thickness of the shaft.

Furthermore, publication DE 199 39 929 A1 shows a needle having a shaft that is provided, along its entire length, with dimples or extensions that form a concave or convex pattern. A knitting tool having a convoluted shaft is also known from this publication.

Considering all the aforementioned needles, the knitting speed of the knitting machine also increases the power necessary for driving the needles, as well as increases the machine temperature.

SUMMARY

It is the object of the invention to decrease the need of power required by the knitting tools, as well as decrease the operating temperature of the knitting machine.

The knitting tool in accordance with the invention comprises a shaft from which extends at least one foot, in which case the shaft has a first height and a first thickness that is reduced at some points. The height should be measured perpendicular to the tool movement direction and perpendicular to the needle back. The thickness should be measured transversely thereto, i.e., perpendicular to the lateral flat sides of the knitting tool. Preferably, but not absolutely necessarily, the area of the thickness-reduced sections of the shaft exceeds the area of the non-thickness-reduced sections of the shaft. From this viewpoint, the area of the shaft extending beyond the foot remains without consideration.

Extending from the shaft there is a straight shaft extension that transitions on its end remote from the shaft in a stitch-forming structure that belongs to the stitch-forming part of the needle. In the case of a latch needle, the stitch-forming structure consists of a hook and a latch. Considering the longitudinal direction of the shaft, the stitch-forming structure ends at the tip of the latch being in its back position. In a compound needle, the stitch-forming structure consists of the hook and the part of the shaft located between the hook and the slide when the slide is in its maximum retracted position. The shaft extension defines a second height that is smaller than the first height of the shaft. This height is defined by the maximum height that is to be measured on the shaft extension. It could be measured on a bump or—if there is no bump on the shaft extension—be defined by the uniform height of the shaft extension, for example.

In addition, the shaft extension has at least two sections displaying different thicknesses. The section of the shaft extension having the smaller thickness is at least as long as the stitch-forming structure. The section of the shaft extension having the smaller thickness may have—at one or more points—a non-reduced thickness in order to form support locations. In other words: The shaft may comprise several locations of reduced thickness that are produced by grinding off material, for example. For thickness reduction, it is possible to provide one or more recesses on one flank or on both flanks, symmetrically or asymmetrically with respect to a longitudinal center plane of the knitting tool.

It applies to the shaft as well as to the shaft extension that the transition between the non-reduced thickness and the reduced thickness may be step-like, ramp-like, rounded or configured in another manner. The boundary between the non-reduced thickness and the reduced thickness may be in a straight line or in a curved line, e.g., arcuate. The boundary may also be arranged between sections of non-reduced thickness and reduced thickness at a right angle with respect to the needle back, inclined thereto or also parallel thereto. Different boundaries may be oriented differently.

Due to the thickness reduction on the shaft extension it is possible to minimize the friction between the shaft extension and the guiding channel of the knitting tool. There is given a certain mobility of the shaft extension transversely to its longitudinal direction, however this mobility does not interfere with the knitting process. Due to the reduced-contact surfaces between the knitting tool and the guiding groove, heat development and needed driving power are reduced. In particular, however, the thickness reduction on the shaft extension prevents too much of a change of the mobility resistance of the knitting tool during its back and forth movement in the guiding groove, as could otherwise occur during a change of the size of the contact surface between the knitting tool and the guiding groove.

The section of the shaft extension having the smaller thickness is arranged directly adjacent the remaining shaft and extends away from said shaft toward the stitch-forming part, in which case the shaft extension again exhibits the originally non-reduced thickness on the stitch-forming part. In this manner, it is possible to combine a gentle thread treatment with the easy mobility of the knitting tool having large sections of reduced thickness.

The section of the shaft extension having the greater thickness is preferably arranged directly adjacent the stitch-forming structure. In this manner, the knitting tool is imparted with high stiffness and lateral stability at the stitch-forming structure.

Preferably, the greater thickness of the shaft extension corresponds to the remaining, non-reduced thickness of the shaft. For example, the knitting tool may be a punched knitting tool of flat material, for example sheet metal, having uniform thickness.

Preferably, the sections having reduced thickness have been produced by cutting or grinding machining processes such as, for example, grinding or embossing, in that the said machining methods are used to impart the lateral surfaces of the shaft and the shaft extension with appropriate recesses. Preferably, the recesses are relatively shallow, wherein the depth of the recesses is within the range of 0.005 mm to 0.05 mm, preferably within the range of 0.01 mm to 0.03 mm. In a preferred embodiment, the depth of the recesses is 0.02 mm. Preferably, the recesses have a flat bottom—apart from their trailing zones—so that the cross-sections of the shaft extension in the thickness-reduced region have straight lateral edges. In doing so, the cross-section is preferably a rectangular cross-section (with rounded corners).

Preferably, the knitting tools in accordance with the invention have the said shallow recesses on both lateral flanks of the shaft extension and preferably also on the flanks of the remaining shaft, so that they can be used in right-rotating machines as well as in left-rotating machines. Furthermore, it is possible in this manner to produce knitting tools displaying particularly minimal straightness deviations. Furthermore, the knitting tools in accordance with the invention are suitable for use in flat bed knitting machines.

Preferably, the shaft of the knitting tool is configured as a meander-shaped strip shaft. To do so, said shaft has strips oriented in longitudinal direction and connecting strips oriented transversely thereto, in which case the strips and connecting strips define a meander shape. The strips and connecting strips may subtend, acute, right or obtuse angles. The angles may be defined uniformly or they may have different sizes. Large sections of the meander-shaped strip shaft preferably have a reduced thickness. However, in the foot region, the thickness is preferably non-reduced. Preferably, at least one other location of non-reduced thickness is provided on the shaft; preferably, two such locations are provided. If a second location of non-reduced thickness is missing on the shaft, it is possible to provide such a location on the shaft extension.

The recesses provided on the shaft of the knitting tool and on the shaft extension preferably have a uniform depth. As a result of this, the reduced thickness of the shaft corresponds to the smaller thickness of the shaft extension. In particular if the shaft has a meander shape, the needle displays a constant lateral resilient flexibility along its length, thus promoting high-speed applications.

Preferably, the knitting tool is a latch needle with a hook and a movably supported latch. However, the aforementioned concept may also be employed with other knitting tools.

BRIEF DESCRIPTION OF THE DRAWINGS

Details of the invention and embodiments thereof result from the description and the dependent claims, and the drawings. They show in:

DETAILED DESCRIPTION

Figure 1:
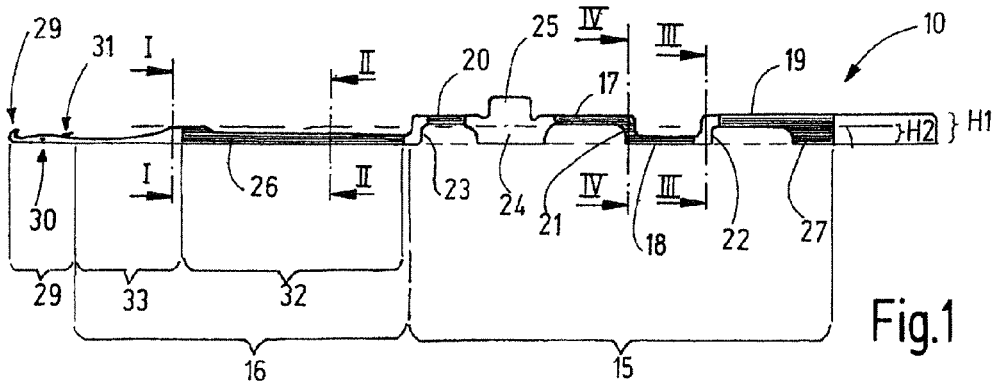
FIG. 1 a side view, in a somewhat schematized representation, of a knitting tool with particular reference being made to the various sections and dimensions.

FIG. 1 shows as the knitting tool 10 a knitting needle as is preferably used in circular knitting machines. There, such knitting tools 10 are arranged in large numbers in guides 11. The guides 11 may, for example, have the form of guiding grooves of a needle bed 12 or be configured in another manner. The needle bed, e.g., may have the form of a knitting cylinder, a ribbed disk or a flat bed. As can be learned from FIG. 2, the guiding groove is delimited by two lateral walls 13, 24, between which the knitting tool 10 is supported so as to be movable in longitudinal direction.

The knitting tool 10 has a shaft 15 from which extends an elongated shaft extension 16, e.g., in the form of a straight extension. The shaft extension 16 may be straight or otherwise elongated, e.g., slightly curved. As shown by FIG. 1, the shaft 15 is preferably a meander-shaped shaft with preferably straight longitudinal strips 17, 18, 19, 20, wherein adjacent longitudinal strips 17, 18, 19 are connected to each other by (again preferably straight) connecting strips 21, 22, these preferably being oriented at a right a angle relative to the longitudinal strips 17, 18, 19. In so doing, the number and positions of the longitudinal strips and the connecting strips in front of and after a foot section 24 are specifically determined by the position of the foot section, as is illustrated by various embodiments.

Figure 16:
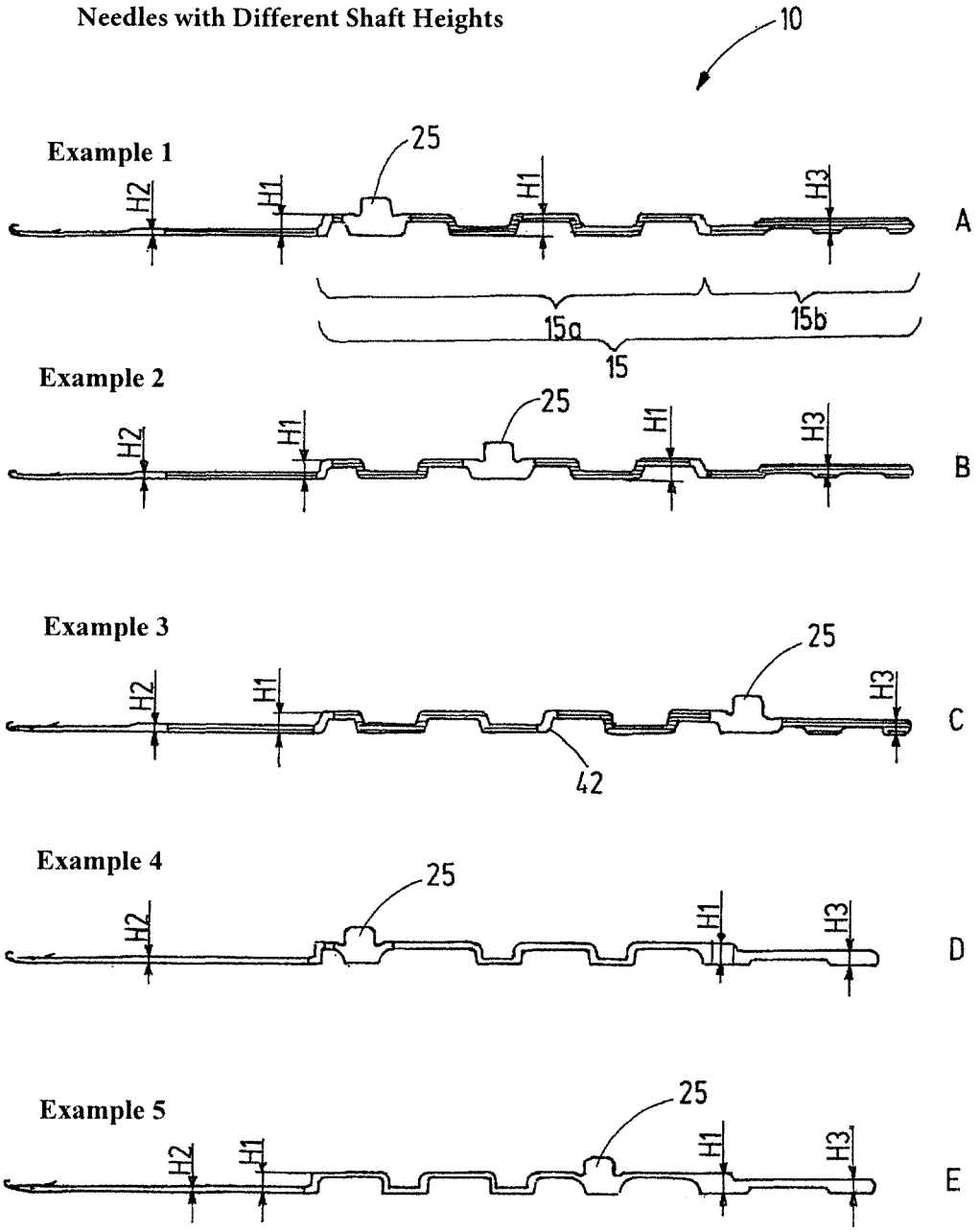

The shaft extension 16 is also connected to a longitudinal strip 20 via a straight connecting strip 23, the latter being oriented at a right angle relative to the shaft extension 16 and the longitudinal strip 20. The longitudinal strips 17, 18, 19 define a first height H1 as the maximum shaft height. Additional embodiments may have additional shaft regions displaying a smaller height H3 (see, e.g., FIG. 16). Between two longitudinal strips 17, 20 is a foot section 24 that extends over the entire height H1 and terminates in a foot 25 extending beyond the upper longitudinal strips 20, 17. Said foot is disposed for driving the knitting tool 10, so that said tool may move back and forth in longitudinal direction in the guiding groove.

The shaft extension 16 extending away from the shaft 15 preferably has a straight lower edge 26 that preferably is in one line with the lower edge as well as the foot section 24 and also additional sections, for example, the longitudinal strip 18, as well as a rear end section 27 of the shaft 15.

The shaft extension 16 has a maximum height H2 that is smaller than the height H1 of the shaft 15. In FIG. 1 and all other exemplary embodiments, the height H2 is understood to mean the maximum height of the shaft extension. The exemplary embodiments explained hereinabove and hereinafter may also be modified in that the maximum second height H2 represents the average height of the shaft extension 16.

On its end remote from the shaft 15, the shaft extension 16 transitions into a stitch-forming structure 28 that is adapted for stitch formation. The stitch-forming structure 28 comprises a hook 29 positioned at the end. Optionally, additional elements may be added such as, for example, a latch 31 that is pivotally supported by a latch bearing 30. In the present exemplary embodiment, its tip—when it is in its back position—marks the end of the stitch-forming structure 28.

The shaft extension 16 represents the connection between the shaft 15 and the stitch-forming structure 28. Said extension—extending from the shaft 15—has a first portion 32 that is shown dark in FIG. 1 and in FIGS. 6, 7, 8. This portion 32 is adjoined by another portion 33 that, finally, terminates in the stitch-forming structure 28. The two sections 32, 33 have different thicknesses D1, D2. In particular, the thickness D1 of portion 32 is smaller than the thickness D2 of portion 33. The stitch-forming structure 28 may have a thickness that corresponds to the thickness D2 of portion 33, or is completely or in some regions again slightly smaller than the latter.

Figure 2:
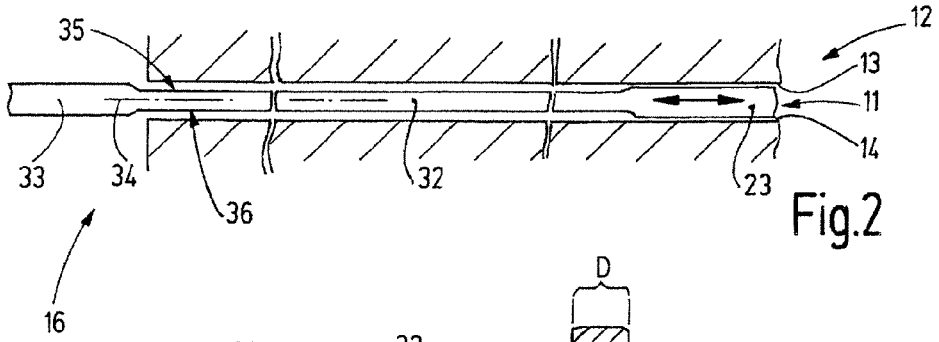
FIG. 2 a plan view of a detail of the knitting tool according to FIG. 1, in a guiding groove of a needle bed.

Preferably, the shaft 15 also has several sections with different thicknesses. All such thickness-reduced regions are depicted dark in FIGS. 1, 6, 7, 8. For example, the longitudinal strips 17, 18, 19, 20 may have a completely or partially reduced thickness that corresponds to or deviates from the reduced thickness D1 of portion 32. Other parts, for example, the foot section 24 and the connecting strips 22, 23 have a non-reduced thickness D that preferably corresponds to the thickness D2 of portion 33. For clarification, the sections 32, 33 in FIG. 2 are shown in plan view. As is obvious, the thickness of portion 33 is such that said thickness fits into the guiding groove. The same applies to the thickness of the connecting strip 23 and the otherwise thicker sections. The thickness reduction of portion 32 is preferably arranged symmetrically to the longitudinal axis of the shaft 34 (FIG. 2). To do so, the two flanks of the shaft extension 16 have recesses 35, 36 with a depth that should be one to five one hundredths of a millimeter, depending on the application. Different depths are possible. As shown by FIG. 2, the recesses 35, 36 may be configured so as to be fully overlapping or, alternatively also be offset relative to each other in longitudinal direction. This applies to each and every embodiment. In any event, in preferred embodiments, the strip 23 arranged between the shaft extension 16 and the shaft 15 is configured with non-reduced thickness D2. Considering all preferred embodiments, at least one additional location of non-reduced thickness D2 is provided on the shaft 15, said thickness D2 being formed by the foot section 24. Additional support points having the thickness D2 may be provided.

Figure 3:
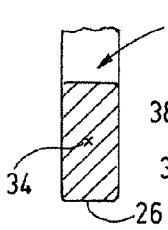
FIG. 3 the cross-section of the knitting tool according to FIG. 1, as a sectional view along line I-I.
Figure 4:
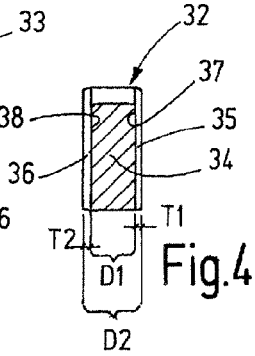
FIGS. 4-4*d* the cross-section of the knitting tool according to FIG. 1, as a sectional view along line II-II.
Figure 5:
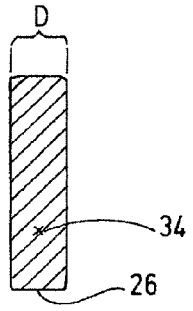
FIG. 5 the cross-section of the knitting tool according to FIG. 1, as a sectional view along line III-III.
Figure 4A:
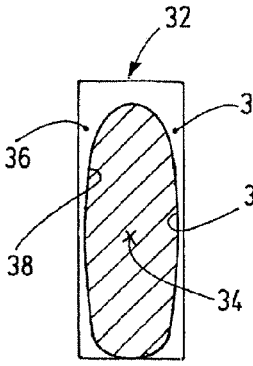
Figure 4B:
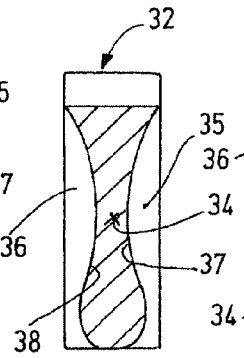
Figure 4C:
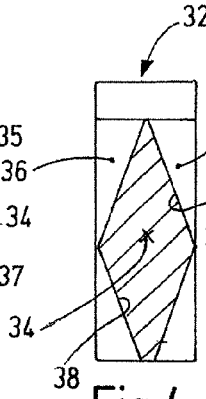
Figure 4D:
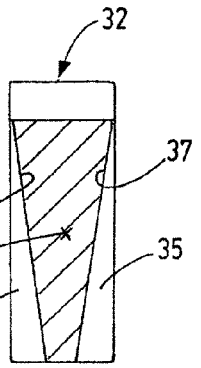

The recesses 35, 36 can again be seen in FIG. 4. FIG. 3 shows the sectional view along line I-I in FIG. 1 through portion 33. FIG. 4 shows the sectional view along line II-II through portion 32 of the shaft extension 16. As is obvious, both recesses 35, 36 have the same depth T1, T2. The bottom of each recess 35 is preferably flat, so that the section on both sides of the knitting tool has straight edges 37, 38. However, it is pointed out that the depths T1 and T2 may be differently configured. Furthermore, the edges 37, 38 of the cross-section in accordance with FIG. 4 may be parallel to each other or, if desired, may also be in a different relationship to each other, e.g., at an acute angle. Furthermore, if needed, they may also be slightly curved. For example, the recesses 35, 36 may have a convex or concave bottom; regarding this, reference is made to the larger scale depictions of FIGS. 4*a* and FIG. 4*b*, for example. It is also possible for the recesses to have a bottom that is completely or partially inclined with respect to other lateral surfaces, as is illustrated by FIGS. 4*c* and 4*d*. In each and every embodiment of the invention, the cross-sectional forms of the shaft extension shown by FIGS. 4*a* to 4*d* may be provided alternatively or additionally, i.e., in the region of the thickness-reduced transverse strips 21 and/or on one or more longitudinal strips 17-20. This results in special advantages, e.g., regarding smooth operation, oil retention and soil resistance.

In accordance with the invention the portion 32 has a length that is greater than the length of the stitch-forming structure 28. Preferably, the length of the portion 32 is also greater than the length of the non-thickness-reduced portion 33. In many embodiments the length of the portion 32 is greater than the sum of the lengths of the stitch-forming structure 28 and the portion 33.

Furthermore, the length of the portion 32 of the shaft extension 16 is greater than the length of the thickness-reduced section of the longitudinal strip 20 that adjoins the shaft extension 16 in the direction of the foot 25 (via the connecting strip 23).

Preferably, the portion 32 is also longer than the thickness-reduced region of the longitudinal strip 17 adjoining the foot region 24, said longitudinal strip 17 contacting the side of the foot section 24 facing away from the shaft extension 16.

The shaft 15 preferably has three regions that are not thickness-reduced. In the knitting tool according to FIG. 1 these are the connecting strip 23, the connecting strip 22 and the foot section 24.

The inventive knitting tool 10 may replace and operate like conventional knitting tools, without modification of the knitting machine. However, the knitting tool has been optimized in view of the required driving power and its temperature behavior. In symmetrical embodiments in accordance with FIG. 1, this applies independently of the direction of rotation of the knitting machine. By reducing the thickness of the portion 32, the contact surface between the knitting tool 10 and the lateral walls 13, 14 of the guiding groove is significantly reduced. At the same time, the knitting tool, in particular the stitch-forming structure 28, is imparted with a certain lateral flexibility, as a result of which the knitting process becomes less sensitive to jerking and jolting problems or the like. Furthermore, dust, deposits and debris may be received by the recesses 35, 36, without resulting in a jamming of the needle. Furthermore, the recesses 35, 36 may act as lubricant reservoirs.

The minimization of the lateral contact between the knitting tool 10, in particular in the region of the shaft extension 16 and the lateral surfaces 13, 14 of the needle bed 12 promotes easy operation of the knitting tool, without compromising the knitting precision. Inasmuch as the recesses 35, 36 do not extend over the entire shaft extension 16 but only in the portion 32 thereof, as well as in select locations of the shaft 15 and in between, there are locations with non-reduced thickness D, D2, such as, for example, in portion 33 as well as the connecting strips 22, 23 and the foot section 24, there are defined support and contact points that position and guide the knitting tool 10 in a precise manner. The length between the individual support locations may be configured consistent with the required application. Regarding this, reference is made to the embodiments of the knitting tool 10 as illustrated by FIGS. 6 to 9 and discussed in summary:

The knitting tools 10 shown in FIGS. 6 to 8 and discussed hereinafter are preferably symmetrical, i.e., the recesses 35, 36 are identical on both sides. However, it is also possible to provide on one side of a knitting tool one of the shown recess patterns and on the other side any other of the shown recess patterns. This results in symmetrical needles having properties that can be independent of the running direction.

Figure 6:
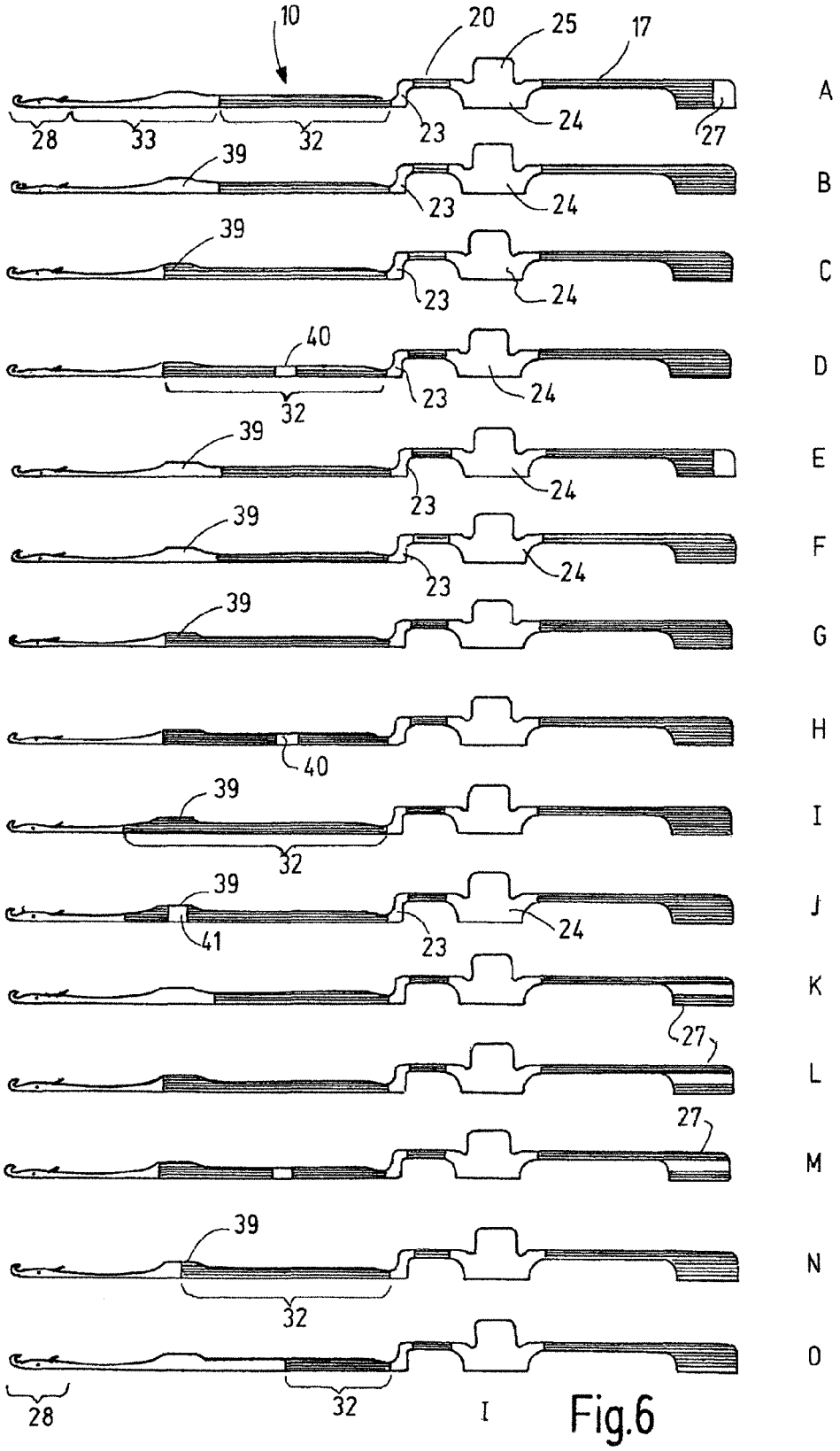
FIGS. 6 to 17 embodiments of various knitting tools, each in side view.

FIG. 6 shows embodiments of relatively short knitting tools 10 with a foot in foot position I, these having respectively only one connecting strip 17, 20 on both sides of the foot 25. For the sake of clarity, the reference signs have mostly been omitted. However, the reference signs introduced in FIG. 1 apply. As is obvious, the knitting tool 10 as in FIG. 6A comprises three support locations without thickness reduction, namely the connecting strip 23, the foot section 24 and a part of the end section 27. The thickness-reduced portion 32 is longer than the portion 33 and longer than the stitch-forming structure 28. This statement, applies without restriction, to each and every embodiment of the knitting tool 10 with the exception of the lowermost indicated needle in FIG. 6O. There, in accordance with the invention, the length of portion 32 is still somewhat greater than the length of the stitch-forming structure 28.

As is shown by FIGS. 6B and C, the portion 32 may end ahead of an elevated section 39 of the shaft extension 16 or extend into said shaft extension. As is shown by FIG. 6D, it is furthermore possible to provide a non-thickness-reduced region on portion 32 in order to aid the lateral support of the shaft extension 16 at this point. The needle as in FIG. 6B has three support locations that are formed by the section 39, the connecting strip 23 and the foot section 24. The needle in accordance with FIG. 6C has the two support locations 23, 24. Again, the needle according to FIG. 6D has three support locations in the form of the region 40 of the connecting strip 23 and the foot section 24.

In the needle according to FIG. 6E, the shaft extension is configured similarly as in FIG. 6B. In addition, the shaft 15 has a non-reduced thickness in the end section 27, so that, again, three support locations are provided on the connecting strip 23, the foot section 24 and the end section 27. The latter is not necessary, as is shown by FIG. 6F. This embodiment can also be modified in accordance with FIG. 6G in that the tapered region of the portion 32 extends into the section 39. If necessary, it is again possible in accordance with FIG. 6H to provide a region 40 for the lateral support of the thickness-reduced region of the shaft extension 16.

FIG. 6I shows another modification. The thickness-reduced portion 32 extends here beyond the elevated section 39, so that a particularly flexible needle is formed. In accordance with FIG. 6J, the lateral support may be formed in the region 39 by an elevated field 41 that is exempt from the thickness reduction and corresponds, regarding its thickness, to the connecting strip 23 and/or the foot section 24. As shown, the field 41 may be rectangular or also square, round or have another form.

FIGS. 6K to M show embodiments wherein non-thickness-reduced regions are provided as a wide longitudinal rib on the end section 27 that effect a lateral support of the end section 27. The shaft extensions 16 may be configured consistent with any of the aforementioned principles and designs, as is meant to be demonstrated by these three examples.

FIG. 6M shows an embodiment that is very similar to that of FIG. 6C, wherein the portion 32 ends in the middle of the elevated section 39. However, as is shown by FIG. 6O, it may also be substantially shorter as has already been emphasized. In addition, the needles according FIGS. 6N and O may be provided with an end section 27 as in FIG. 6A or FIG. 6K. Additional modifications are possible.

Figure 7:
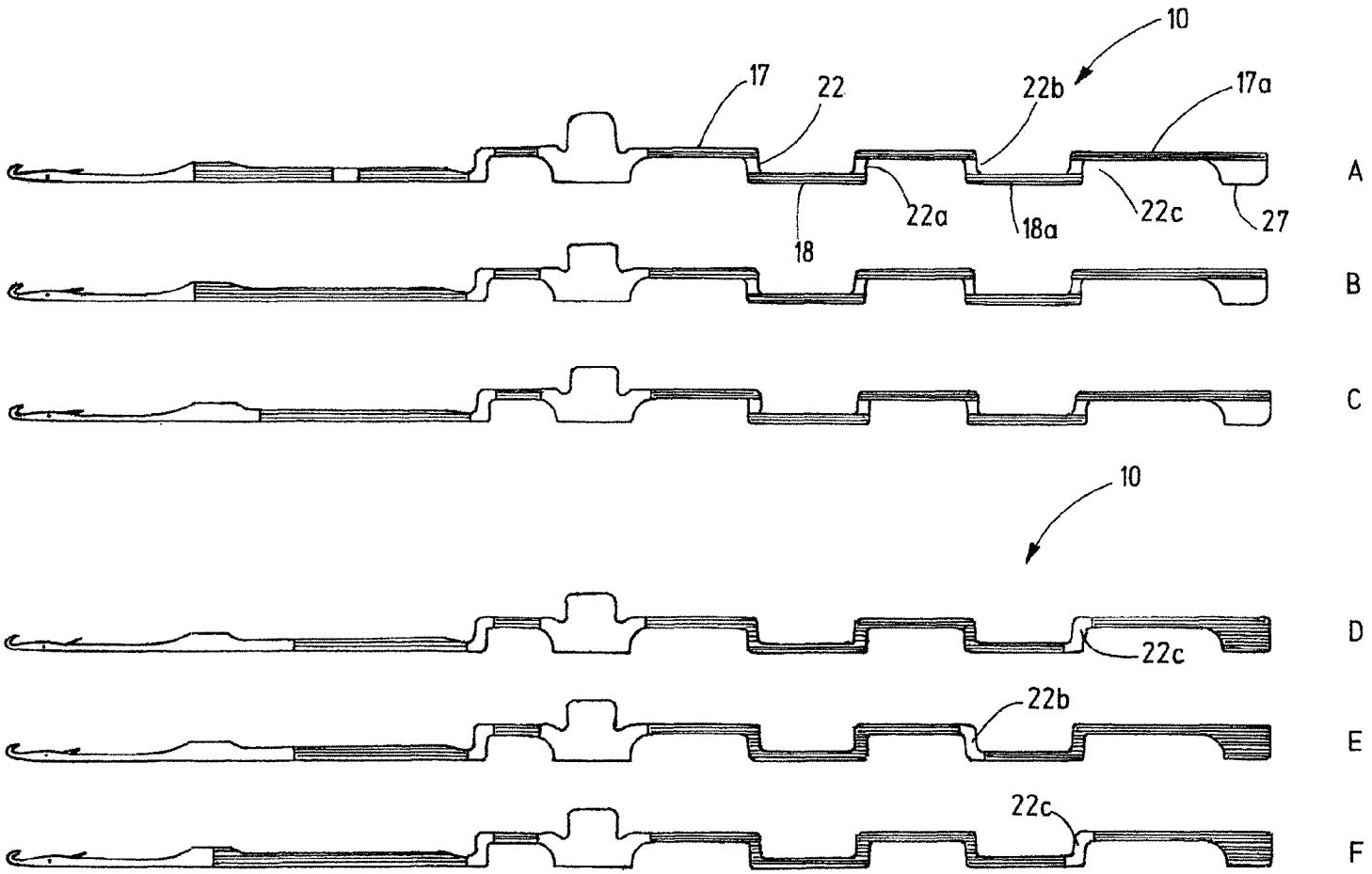
Figure 8:
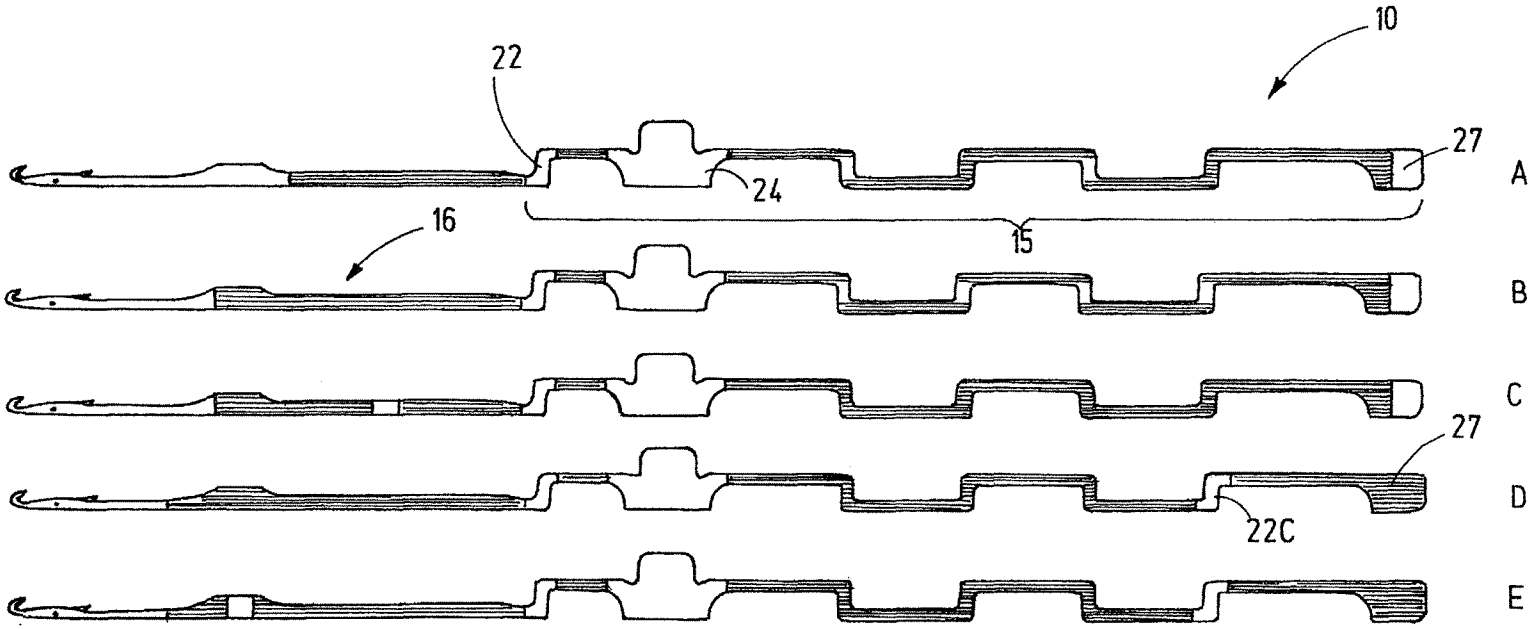

FIGS. 7 and 8 illustrate additional embodiments of the knitting tool 10 of the invention herein with a longer shaft 15.

Considering the shaft extension 16, again each and every configuration as in FIGS. 6A to O is possible and can be combined with any of the embodiments of the shaft 15 explained hereinafter. As is shown by FIGS. 7A and B, all connecting strips 22, 22*a, b, c* may preferably be provided with vertically centrally placed non-thickness-reduced regions. In contrast, the longitudinal strips 17, 18, etc. are thickness-reduced, in which case the thickness reduction may extend, as needed, up to the connecting strip 22 to 22*c* and into said connecting strip. This applies analogously to the end section 27 that—in alignment with the adjoining thickness-reduced longitudinal strip 17*a*—may also have a thickness reduction.

Different therefrom, only individual connecting strips 22*c*, 22*b* or also others are non-thickness-reduced in the embodiments according to FIGS. 7D through F. Again, this shaft configuration may be combined in each and every of the previously described configurations of shaft extensions, with FIGS. 7D to F only providing examples.

FIGS. 8A to E show additional examples. For example, a shaft 15 may be provided, said shaft having support locations formed only by the connecting strip 22, the foot region 24 and the end section 27 connected to the foot region 24 via many meanders. In the case of this needle, all the previously described shaft extensions 16 may be used, this being indicated only in an exemplary manner by FIGS. 8B and C. Instead of the end section 27, also another location may provide a support due to the non-thickness reduced region, for example by connecting strip 22*c*, as is illustrated by FIGS. 8D and E. Again, all the configurations of the previously described shaft extensions 16 may be used.

Figure 9:
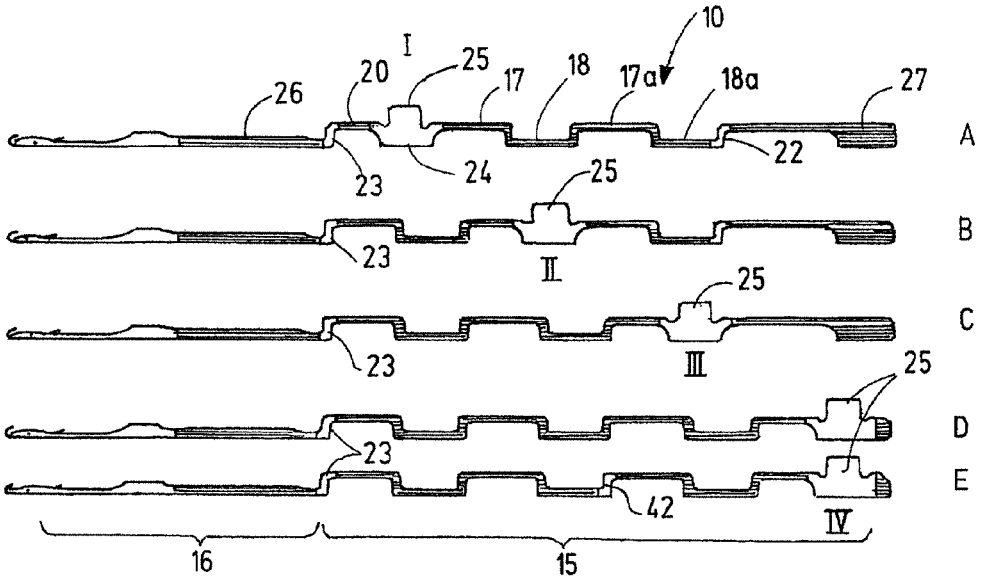

FIG. 9 shows additional embodiments of the knitting tool 10 in accordance with the invention that illustrate modifications of the knitting tool shown in FIG. 9A, said knitting tool largely corresponding to the knitting tool of FIG. 1 and, in so far, is be understood to be same—in view of its description and based on the same reference signs. Different from the knitting tool 10 according to FIG. 1, the knitting tool 10 according to FIG. 9A has additional longitudinal strips 17*a*, 18*a* arranged between the longitudinal strip 18 and the connecting strip 22, said additional strips forming a meander arrangement with the longitudinal strips 17, 18 and, at the same time, having reduced thickness. The knitting tools shown hereunder in FIGS. 9B, 9E are different due to their position of the respective foot 25 or the configuration of the meander in the shaft 15. As shown by FIGS. 9B and 9D, the foot 25 may also be arranged in foot position II, III or IV at a greater distance from the shaft extension 16. Due to the four different positions I through IV for the foot 25, the respective needles may interact with different paths of a knitting tappet and thus perform different working movements. As is shown by FIGS. 9B to 9D, the shaft 15 may have a completely reduced thickness between the foot 25 and the connecting strip 23. In particular with needles having the foot 25 in foot position IV, it may however be useful to interpose at least one, optionally also more, support locations between the foot 25 and the connecting strip 23. Such support locations are formed, for example, by a region or a field 42 that is not thickness-reduced. Such a field 42 may be provided on a connecting strip and assume its entire height or only parts thereof.

Figure 10:
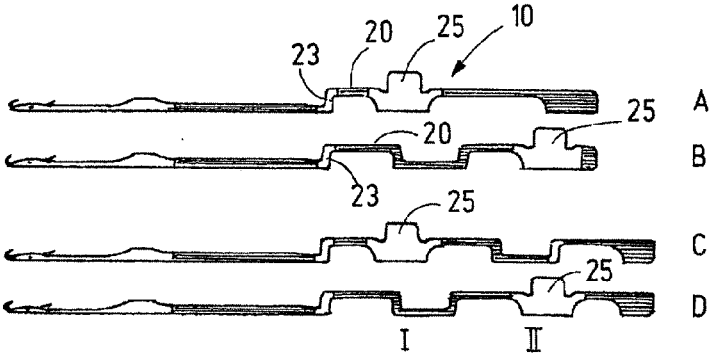

FIG. 10 shows examples of knitting tools 10 with shorter shafts (FIGS. 10A, 10B) or with longer shafts (FIGS. 10C, 10D) in various foot positions in positions I and II. As is already obvious in the example of FIG. 9, it is clear that only the longitudinal strip 20 or a meander-shaped structure comprising one or more longitudinal strips and connecting strips may be arranged between the foot 25 and the connecting strip 23 (see FIG. 10B or 10D).

Figure 11:
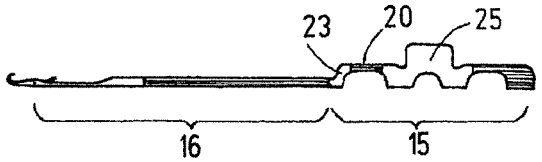

For single-path machines, the knitting tools according to FIG. 11 may be provided. They may have a shaft 15 that does not have a meander structure. In this case, the foot 25 is connected directly to the shaft extension 16—via the longitudinal strip and the connecting strip. The shaft extension 16 may be longer than the shaft 15.

Figure 12:
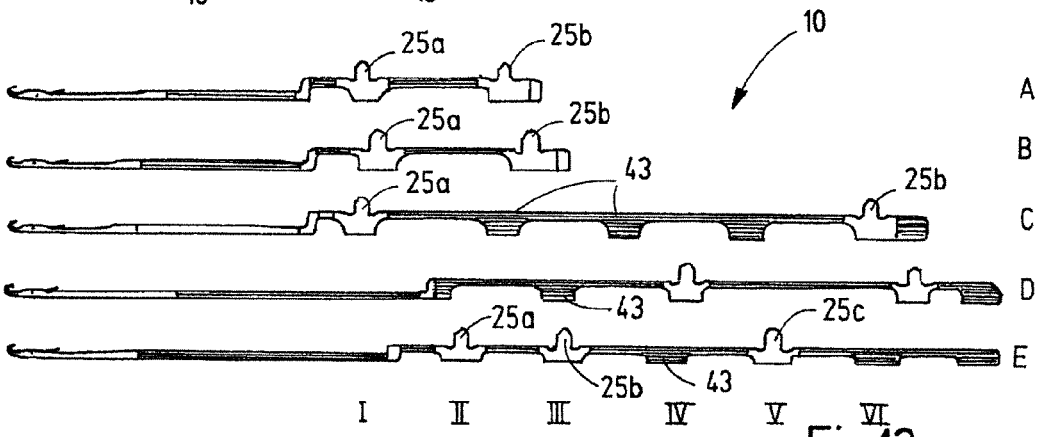

FIG. 12 shows different embodiments of additional groups of needles. These are knitting tools 10 with several feet 25*a*, 25*b*, 25*c* in different positions. The shaft 15 may be formed as a straight strip between the feet 25*a*, 25*b*, as is shown by FIGS. 12A and 12B, as well as by FIG. 12D. Between the feet 25*a*, 25*b* and/or 25*c*, the shaft may also have vertical support sections that are similar to the foot sections 24, without a meander-shape being formed as a result of this. Such support sections 43 can be inferred from FIGS. 12C, 12D and 12E. Other than that, the previous description of the other embodiments of the knitting tool 10 applies analogously.

Figure 13:
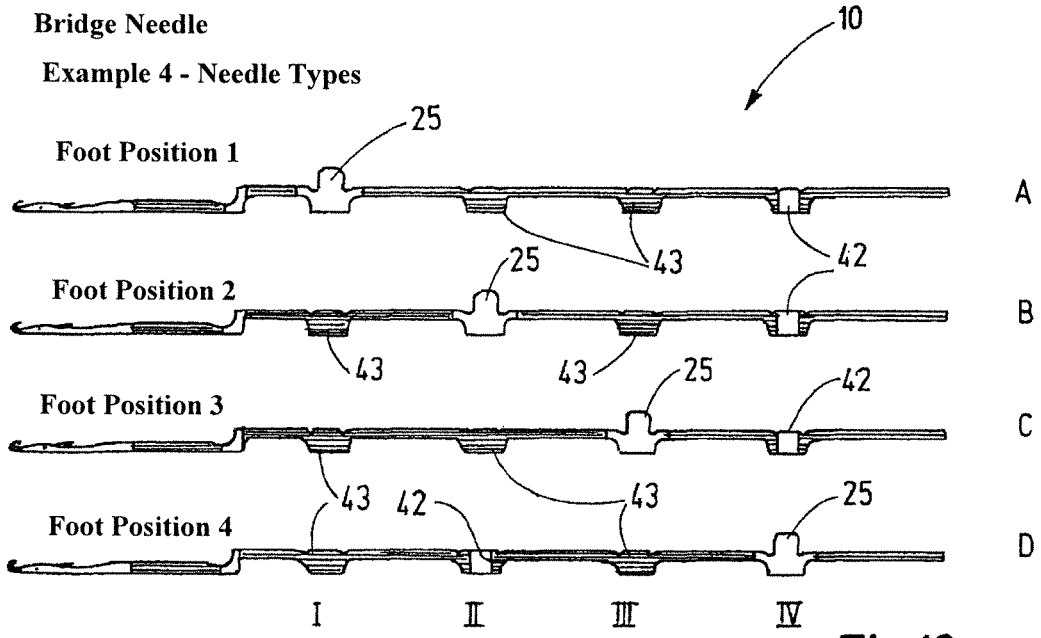

Further modifications are possible. Regarding this, FIG. 13 shows as the knitting tool 10 the so-called bridge needles whose foot 25 can be arranged depending on embodiment (A-D) in any desired position I to IV. As in all the other previously described knitting tools, the foot section 24 is configured here with a non-reduced thickness. Additional support sections 43 corresponding to the foot sections 24 may be arranged on the shaft on both sides of the foot 25. Such support sections 43 may be thickness-reduced. However, they may also comprise fields 42 of non-reduced thickness in order to effect a lateral support.

Figure 14:
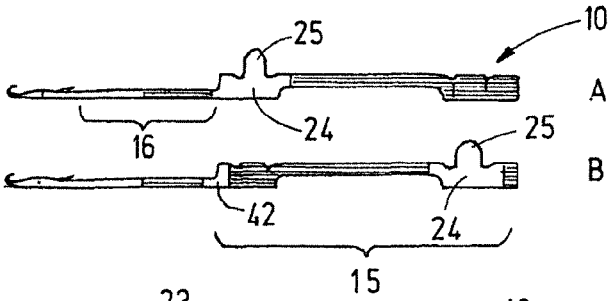

A further instructive example of a knitting tool according to the invention is shown by FIG. 14. The knitting tool 10 in accordance with FIG. 14A comprises a foot 25 on a foot section 24 that directly adjoins the shaft extension. Shaft regions or shaft extension regions displaying reduced thickness extend on both sides of the foot section 24. Considering this, the embodiment in accordance with FIG. 14B is derived therefrom. In this embodiment, the foot 25 is arranged on the rear end of the shaft. At the transition between the shaft extension 16 and the shaft 15 there may again be provided a field 42 with non-reduced thickness for the lateral support of the knitting tool 10.

Figure 15:
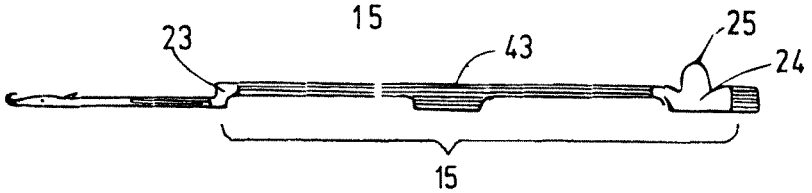

FIG. 15 illustrates another modified example. As in FIG. 14B, the foot 25 is arranged on the rear end of the shaft 15. The shaft 15 is configured as an elongated, straight shaft with a support section 43. The shaft 15 is laterally supported by the connecting strip 23 and the foot section 24.

FIG. 16 again illustrates a group of meander-shaped needles with different shaft shapes and foot positions. The embodiments are exemplary of the knitting tools 10 whose shaft 15 is divided into a first section 15*a* having a greater height H1 and a second section 15*b* having a height H3 that is smaller than the height H1 but preferably greater than the height H2 of the shaft extension. However, it may also be smaller than the height H2. Considering the foot positions, the fields 42 or other design variants, reference is made to the descriptions of previous embodiments hereinabove.

Figure 17:
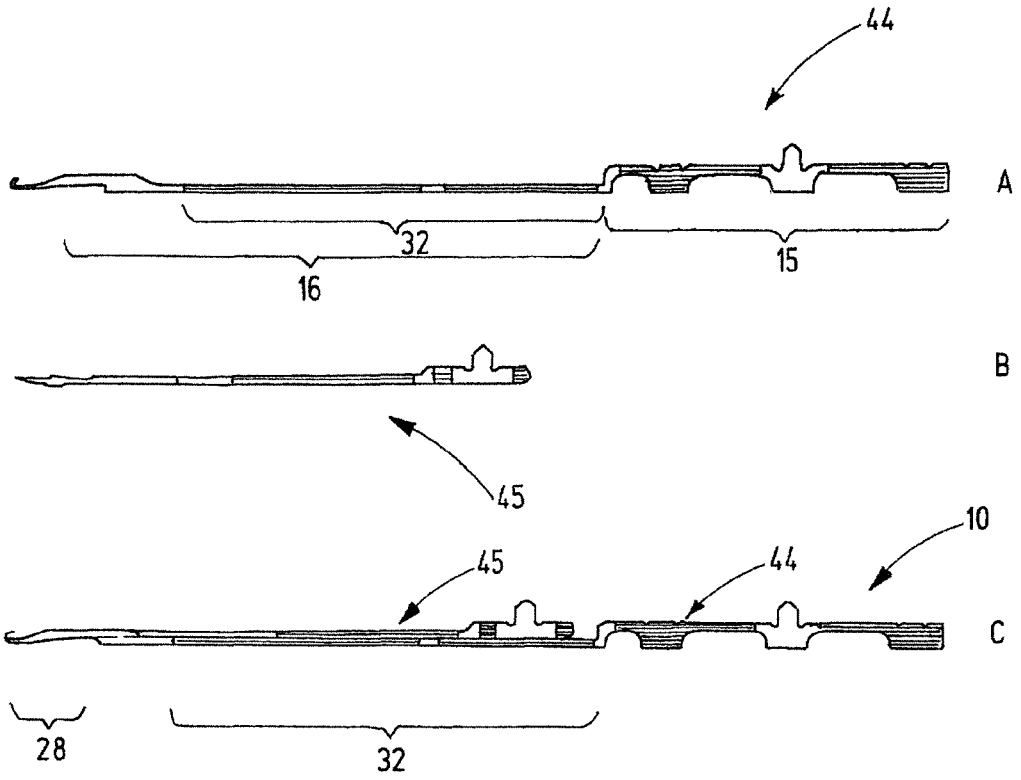

The inventive concept explained initially in general and then with reference to various exemplary embodiments in particular, can be implemented not only with latch needles of the most diverse types but also on other knitting tools, e.g., compound needles. FIG. 17 shows such a knitting tool 10 comprising a needle 44 that interacts with a slide 45. The slide 45, as well as the needle 44, are configured in accordance with the principle that the thickness-reduced portion 32 of the shaft extension 16 is at least as long as the stitch-forming structure 28.

A knitting tool 10, in particular a latch needle, intended for a high-speed knitting machine has a meander-shaped shaft with thickness-reduced regions. Adjoining the meander-shaped shaft is a straight shaft extension 16 that also has a thickness-reduced portion 32. Due to its height H2 that is smaller than the height H1 of the shaft 15, the shaft extension 16 is separated from the shaft 15. The thickness-reduced region 32 of the shaft extension 16 has a length that is at least clearly greater than the length of the stitch-forming structure 28 carried by the shaft extension 16. Preferably, the thickness-reduced region 32 is overall longer than the non-thickness-reduced region of the shaft extension 16. This configuration provides a surprisingly powerful knitting tool 10 suitable for high operating speeds.

LIST OF REFERENCE SIGNS

| | |
|---|---|
| 10 | Knitting tool |
| 11 | Guide |
| 12 | Needle bed |
| 13, 14 | Lateral walls |
| 15 | Shaft 15a, 15b-sections thereof |
| 16 | Shaft extension |
| 17-20 | Longitudinal strips |
| 21-23 | Connecting strips |
| H1 | First height, height of shaft 15 |
| 24 | Foot section |
| 25 | Foot |
| 26 | Lower edge/needle back |
| 27 | End section of shaft 15 |
| H2 | Second height, height of shaft extension 16 |
| 28 | Stitch-forming structure |
| 29 | Hook |
| 30 | Latch bearing |
| 31 | Latch |
| 32 | Reduced-thickness portion (region) of shaft extension 16 |
| 33 | Portion of shaft extension 16 without thickness reduction 16 |
| 34 | Longitudinal axis of the shaft |
| 35, 36 | Recesses |
| T1, T2 | Depth of the recesses 35, 36 |
| 37, 38 | Lateral edges of the cross-section in portion 32 |
| 39 | Elevated section |
| 40 | Non-thickness-reduced portion (region) of the portion 32 |
| 41, 42 | Field |
| I-VI | Foot locations/foot positions |
| 43 | Support section |
| 44 | Needle |
| 45 | Slide |
| 46 | |

The invention claimed is:

1. Knitting tool (10) for flat bed or circular knitting machines with at least one needle bed (12) that has guides (11) for knitting tools (10) that are movably guided in longitudinal direction, wherein the knitting tool (10) comprises:

a shaft (15) provided with at least one foot (25), said shaft having a first height (H1) and at least a first portion having a first non-reduced thickness (D2) that transitions to a second portion having a reduced thickness (D1) relative to the first portion, an elongated shaft extension (16) that extends away from the shaft (15) and transitions on its end remote from the shaft (15) into a stitch-forming structure (28), in which case the shaft extension (16) has a second height (H2) that is smaller than the first height (H1), a connecting strip (23) connected the elongated shaft extension (16) to the shaft (15) by having a first end of the connecting strip (23) connected to the elongated shaft extension (16) at approximately a right angle and by connecting a second end of the connecting strip (23) to the shaft (15) at approximately a right angle, wherein the elongated shaft extension (16) has at least two sections (32, 33) with different thicknesses (D1, D2), wherein a section (32) of the at least two sections of the shaft extension (16) having a smaller thickness (D1) is at least as long as the stitch-forming structure (28), wherein the connecting strip (23) has a thickness corresponding to the first non-reduced thickness (D2).

2. Knitting tool as in claim 1, wherein the section (32) of the shaft extension (16) having the smaller thickness (D1) adjoins the connecting strip (23).

3. Knitting tool as in claim 1, wherein a section (33) of the at least two sections of the shaft extension (16) having a greater thickness (D2) adjoins the stitch-forming structure (28).

4. Knitting tool as in claim 3, wherein the greater thickness (D2) of the shaft extension (16) corresponds to the non-reduced thickness (D2) of the shaft (15).

5. Knitting tool as in claim 1, wherein the section (32) of the shaft extension (16) having the smaller thickness (D1) has, in at least one location (II-II), a cross-section with straight lateral edges (37, 38).

6. Knitting tool as in claim 1, wherein the section (32) of the shaft extension (16) having the smaller thickness (D1) has, in at least one location (II-II), a cross-section that is rectangular.

7. Knitting tool as in claim 1, wherein the section (32) of the shaft extension (16) having the smaller thickness (D1) has, in at least one location (II-II; II-II), a cross-section that is centered symmetrically relative to the tool's center axis (34).

8. Knitting tool as in claim 1, wherein the shaft (15) is configured as a meander-shaped strip shaft.

9. Knitting tool as in claim 1, wherein the shaft (15) has at least three locations with the non-reduced thickness (D2).

10. Knitting tool as in claim 1, wherein the at least one foot (25) is arranged on a foot section (24) of the shaft (15), in which case the foot section has a non-reduced thickness (D2).

11. Knitting tool as in claim 1, wherein the shaft (15) has locations of reduced thickness adjoining the foot (25).

12. Knitting tool as in claim 11, wherein the reduced thickness (D1) of the shaft (15) corresponds to the smaller thickness (D1) of the shaft extension (16).

13. Knitting tool as in claim 1, wherein the stitch-forming structure (28) comprises a hook (29).

14. Knitting tool as in claim 1, wherein the stitch-forming structure (28) comprises a latch (31).

* * * * *